US008342106B2

(12) United States Patent
Krupka et al.

(10) Patent No.: US 8,342,106 B2
(45) Date of Patent: Jan. 1, 2013

(54) MODULAR PALLET

(75) Inventors: Charles R. Krupka, East Lansing, MI (US); Anthony Taft, Belding, MI (US); Gary D. Werner, Lakewood, CO (US)

(73) Assignee: Meridian Tool Leasing & Maintenance, LLC, Okemos, MI (US)

( * ) Notice: Subject to any disclaimer, the term of this patent is extended or adjusted under 35 U.S.C. 154(b) by 0 days.

(21) Appl. No.: 13/275,600

(22) Filed: Oct. 18, 2011
(Under 37 CFR 1.47)

(65) Prior Publication Data

US 2012/0132114 A1 May 31, 2012

Related U.S. Application Data

(60) Provisional application No. 61/394,745, filed on Oct. 19, 2010.

(51) Int. Cl.
*B65D 19/38* (2006.01)

(52) U.S. Cl. ..... 108/57.25; 108/902

(58) Field of Classification Search ..... 108/57.25, 108/57.26, 57.27, 901, 902, 56.3, 56.1, 51.11, 108/51.3
See application file for complete search history.

(56) References Cited

U.S. PATENT DOCUMENTS

| | | | | |
|---|---|---|---|---|
| 3,464,371 | A * | 9/1969 | Gifford | 108/51.3 |
| 4,936,229 | A * | 6/1990 | Parnell | 108/51.3 |
| 5,090,336 | A * | 2/1992 | Longaker et al. | 108/57.26 |
| 5,458,069 | A * | 10/1995 | Stolzman | 108/56.3 |
| 5,537,935 | A * | 7/1996 | Otaguchi et al. | 108/51.3 |
| 5,570,643 | A | 11/1996 | Werner | |
| 6,837,170 | B2 | 1/2005 | Taft | |
| 6,948,434 | B2 * | 9/2005 | Horiuchi | 108/51.3 |
| 7,004,083 | B2 * | 2/2006 | Ramirez von Holle et al. | 108/57.25 |
| 7,475,639 | B2 * | 1/2009 | Chen | 108/51.3 |
| 7,490,561 | B1 * | 2/2009 | Chou | 108/56.1 |
| 7,516,706 | B2 | 4/2009 | Creighton et al. | |
| 2003/0136315 | A1 * | 7/2003 | Kim | 108/57.28 |
| 2005/0081763 | A1 * | 4/2005 | Ramirez von Holle et al. | 108/56.1 |
| 2005/0166804 | A1 * | 8/2005 | Hansen | 108/56.3 |
| 2009/0223421 | A1 * | 9/2009 | Ferguson | 108/51.3 |

* cited by examiner

*Primary Examiner* — Jose V Chen
(74) *Attorney, Agent, or Firm* — Reising Ethington P.C.

(57) ABSTRACT

A board for a modular pallet including spaced apart mating sections that include tab sections including angled portions along the edges, and inboard facing shoulders spaced from the ends of the boards and adjacent to the tab sections, and a modular pallet including the board.

27 Claims, 5 Drawing Sheets

MODULAR PALLET

This application claims the benefit of U.S. Provisional Application No. 61/394,745, filed Oct. 19, 2010, the content of which is incorporated herein by reference in its entirety.

TECHNICAL FIELD

This disclosure relates generally to pallets and, more particularly, to modular pallets and boards for modular pallets.

BACKGROUND

Pallets typically include three modular stringers and three to five top and bottom modular boards spanning the modular stringers. Current modular pallets do not accept more than three modular stringers.

SUMMARY

In accordance with one illustrative embodiment, there is provided a board for a modular pallet. In accordance with another illustrative embodiment, there is provided a modular pallet.

BRIEF DESCRIPTION OF THE DRAWINGS

Features and advantages of one or more of the disclosed embodiments of this disclosure will be apparent to those of ordinary skill in the art from the following detailed description of exemplary embodiments and the claims, with reference to the accompanying drawings in which:

DETAILED DESCRIPTION

The content of U.S. Pat. No. 6,837,170 is incorporated herein by reference in its entirety.

In general, an article and apparatus will be described using one or more examples of exemplary embodiments of a modular board having first and second mating sections at first and second ends thereof, and third and fourth spaced apart mating sections disposed inboard of the first and second mating sections, and a modular pallet that includes a plurality of the aforementioned board.

Figure 1:
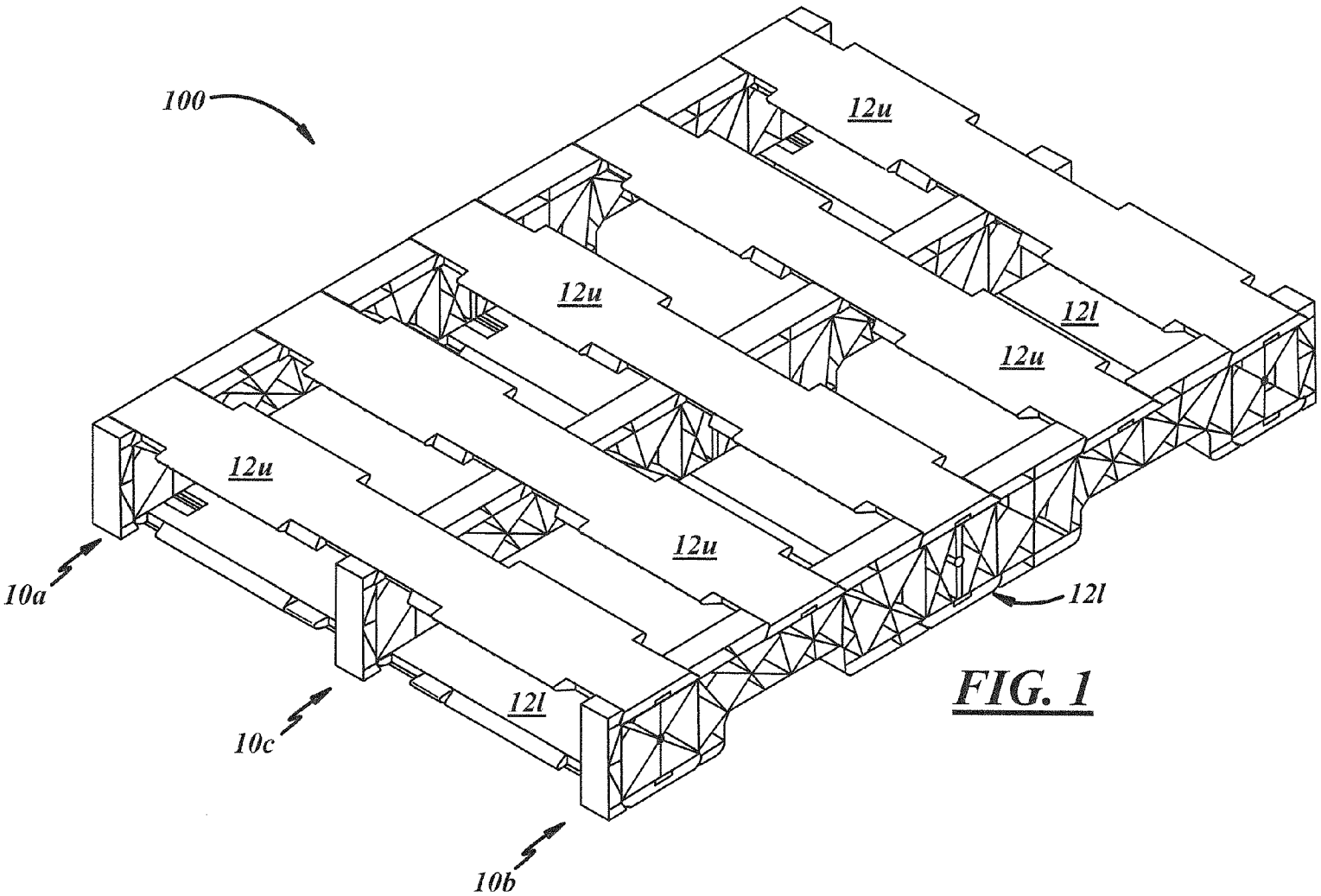
FIG. 1 is a perspective view according to an exemplary embodiment of a modular pallet having three stringers.

Referring specifically to the drawings, FIG. 1 illustrates an exemplary embodiment of a modular pallet 100 including a plurality of stringers 10*a*, 10*b*, 10*c* and a plurality of boards 12*u*, 12*l* coupled to the stringers 10*a*, 10*b*, 10*c*. As will be described in greater detail below, the modular pallet 100 includes a novel arrangement of boards and stringers, particularly wherein the boards include novel features to increase the pallet load carrying capacity with little to no increase in complexity compared to conventional modular pallets. As used herein, the term "stringer" is a term of art in the pallet art and may include a support member for a pallet regardless of material type or the like. Also, as used herein, the term "board" is a term of art in the pallet art and may include a member, deck member, and/or the like regardless of material type or the like.

FIG. 1 illustrates only three stringers 10*a*, 10*b*, 10*c*, and the stringers 10*a*, 10*b*, 10*c* may be spaced apart and spaced substantially parallel with respect to one another. The stringers 10*a*, 10*b*, 10*c* may include a first stringer 10*a*, a second stringer 10*b*, and a third stringer 10*c*. The first and second stringers 10*a*, 10*b* may constitute a first pair of outboard stringers.

The boards 12*u*, 12*l* include upper boards 12*u* and lower boards 12*l*. The pallet 100 preferably includes more than three of each of the boards 12*u*, 12*l*. For example, the pallet 100 may include five of the upper boards 12*u*, and three of the lower boards 12*l*, although any suitable quantities of the boards 12*u*, 12*l* may be used. In any event, the boards 12*u*, 12*l* are constructed for use with pallets having more than three stringers as will be discussed in greater detail below.

Figure 2:
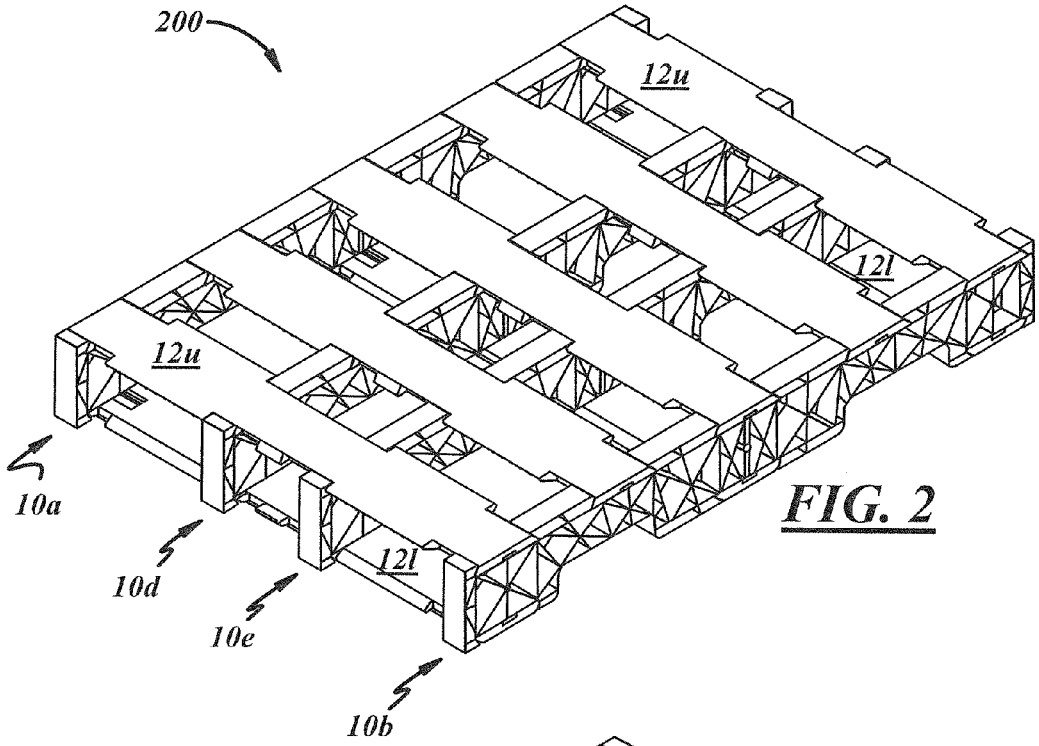
FIG. 2 is a perspective view according to an exemplary embodiment of a modular pallet having four stringers.

FIG. 2 illustrates another exemplary embodiment of a modular pallet 200. This embodiment is similar in many respects to the embodiment of FIG. 1 and like numerals between the embodiments generally designate like or corresponding elements throughout the several views of the drawing figures. Additionally, the descriptions of the embodiments are incorporated by reference into one another and the common subject matter generally may not be repeated here.

The pallet 200 includes the upper and lower boards 12*u*, 12*l*, and the first and second stringers 10*a*, 10*b*. Additionally, the pallet 200 includes fourth and fifth stringers 10*d*, 10*e* but omits the third stringer 10*c* of FIG. 1 for a total of four stringers. The fourth and fifth stringers 10*d*, 10*e* constitute a pair of stringers disposed between the first pair of outboard stringers.

Figure 3:
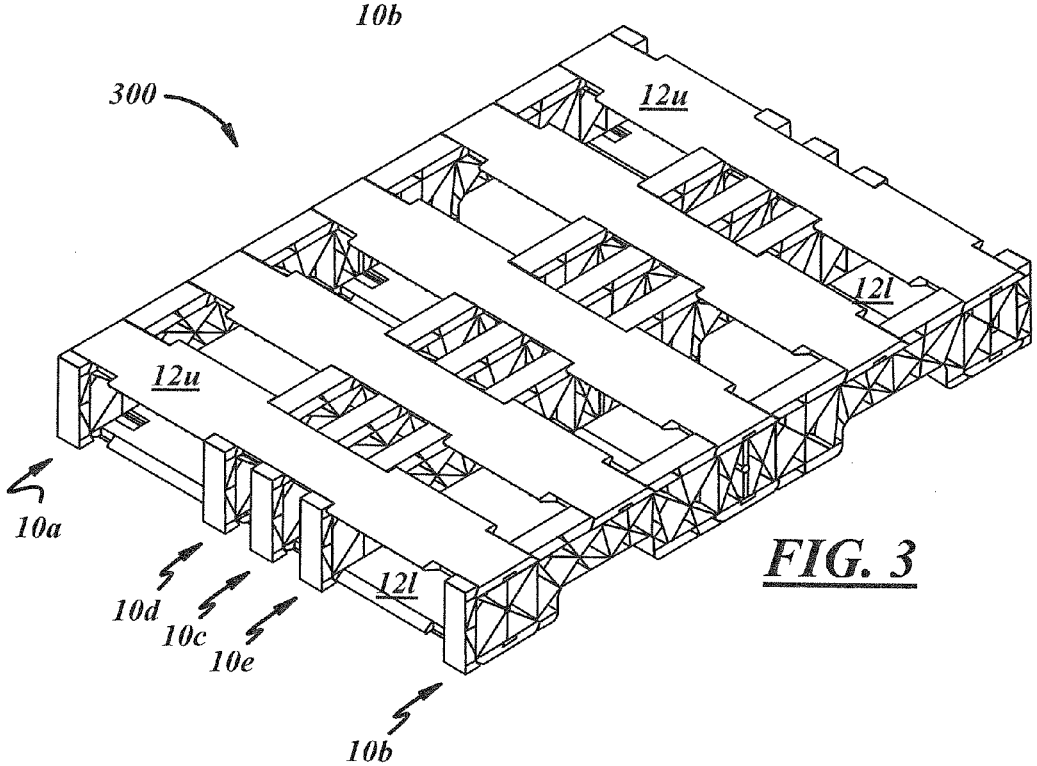
FIG. 3 is a perspective view according to an exemplary embodiment of a modular pallet having five stringers.

FIG. 3 illustrates another exemplary embodiment of a modular pallet 300. This embodiment is similar in many respects to the embodiments of FIGS. 1 and 2, and like numerals between the embodiments generally designate like or corresponding elements throughout the several views of the drawing figures. Additionally, the descriptions of the embodiments are incorporated by reference into one another and the common subject matter generally may not be repeated here.

The pallet 300 includes the upper and lower boards 12*u*, 12*l*, the first, second, and third stringers 10*a*, 10*b*, 10*c*, and the fourth and fifth stringers 10*d*, 10*e* for a total of five stringers.

Figure 4:
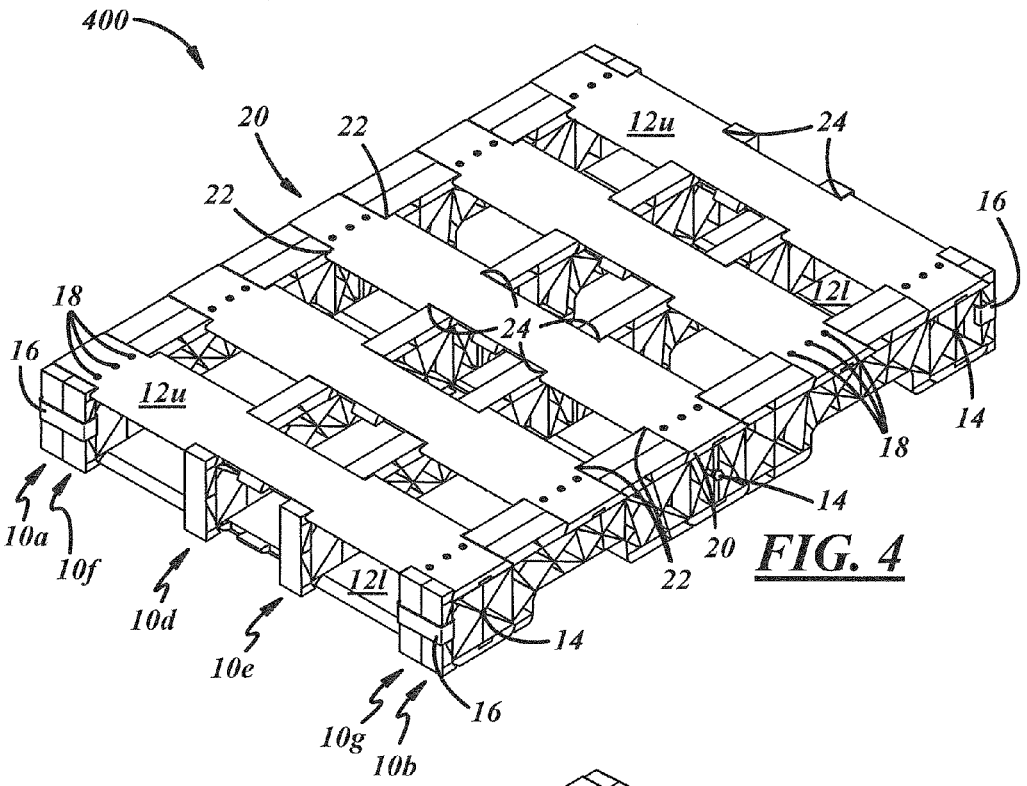
FIG. 4 is a perspective view according to an exemplary embodiment of a modular pallet having six stringers.

FIG. 4 illustrates another exemplary embodiment of a modular pallet 400. This embodiment is similar in many respects to the embodiments of FIGS. 1 through 3, and like numerals between the embodiments generally designate like or corresponding elements throughout the several views of the drawing figures. Additionally, the descriptions of the embodiments are incorporated by reference into one another and the common subject matter generally may not be repeated here.

The pallet 400 includes the upper and lower boards 12*u*, 12*l*, the first, and second stringers 10*a*, 10*b*, the fourth and fifth stringers 10*d*, 10*e*, adds sixth and seventh stringers 10*f*, 10*g*, but omits the third stringer 10*c* for a total of six stringers. The sixth and seventh stringers 10*f*, 10*g* constitute a second pair of outboard stringers that are disposed between the first pair of outboard stringers 10*a*, 10*b*. The first and second outboard pairs of spaced apart stringers may be in adjacent contact.

Also, the first and second outboard pairs of spaced apart stringers may be coupled together. More specifically, the first and second outboard pairs of spaced apart stringers may be coupled together by screws 14, clips 16, or any other suitable fasteners, couplers, and/or the like. The screws 14 may extend through the first and second stringers 10*a*, 10*b* and may be threaded into corresponding portions of the sixth and seventh stringers 10*f*, 10*g*. The clips 16 may be located at stringer ends so as to clip together the opposed ends of the first and sixth stringers 10*a*, 10*f*, and the opposed ends of the second and seventh stringers 10*b*, 10*g*.

The boards 12*u*, 12*l* may be coupled to the sixth and seventh stringers 10*f*, 10*g*. For example, the boards 12*u*, 12*l* may be fastened thereto. More specifically, the boards 12*u*, 12*l* may be fastened to the stringers 10*f*, 10*g* by screws 18, rivets, or any other suitable fasteners.

The boards 12*u*, 12*l* may include opposed ends 20 and outboard facing shoulders 22 spaced from the opposed ends 20, wherein inboard portions of the second outboard pair of spaced apart stringers 10*f*, 10*g* may abut the shoulders 22 so that the stringers 10*f*, 10*g* may be trapped between the outboard facing shoulders 22 and the first outboard pair of spaced apart stringers 10*a*, 10*b*. Accordingly, the second outboard pair of spaced apart stringers 10*f*, 10*g* may be integrally coupled to the pallet 400. Such abutment, entrapment, and/or integral coupling may increase rigidity and/or load carrying capacity of the pallet 400.

Likewise, the boards 12*u*, 12*l* may have inboard facing shoulders 24 spaced from the ends 20 of the boards 12*u*, 12*l*, wherein outboard portions of the inboard pair of spaced apart stringers 10*d*, 10*e* abut the inboard facing shoulders 24. Such abutment may increase the rigidity of the pallet 400.

Figure 5:
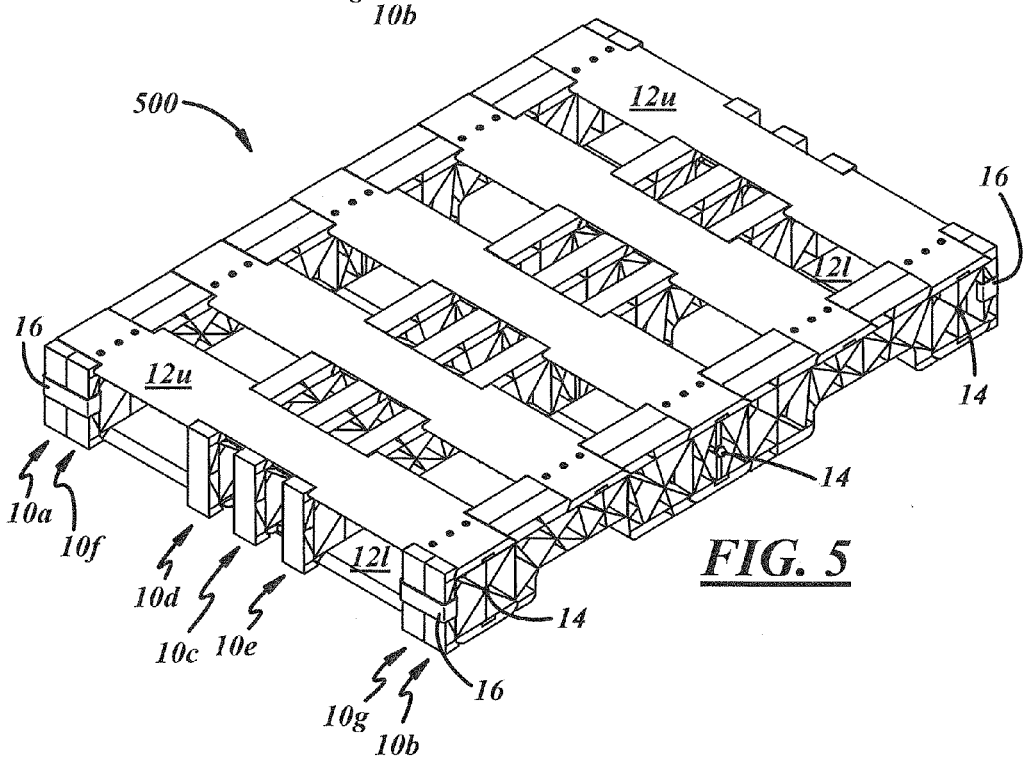
FIG. 5 is a perspective view according to an exemplary embodiment of a modular pallet having seven stringers.

FIG. 5 illustrates another exemplary embodiment of a modular pallet 500. This embodiment is similar in many respects to the embodiments of FIGS. 1 through 4, and like numerals between the embodiments generally designate like or corresponding elements throughout the several views of the drawing figures. Additionally, the descriptions of the embodiments are incorporated by reference into one another and the common subject matter generally may not be repeated here.

The pallet 500 includes the upper and lower boards 12*u*, 12*l*, the first, and second stringers 10*a*, 10*b*, the fourth and fifth stringers 10*d*, 10*e*, the sixth and seventh stringers 10*f*, 10*g*, as well as the third stringer 10*c* for a total of seven stringers.

Figure 6:
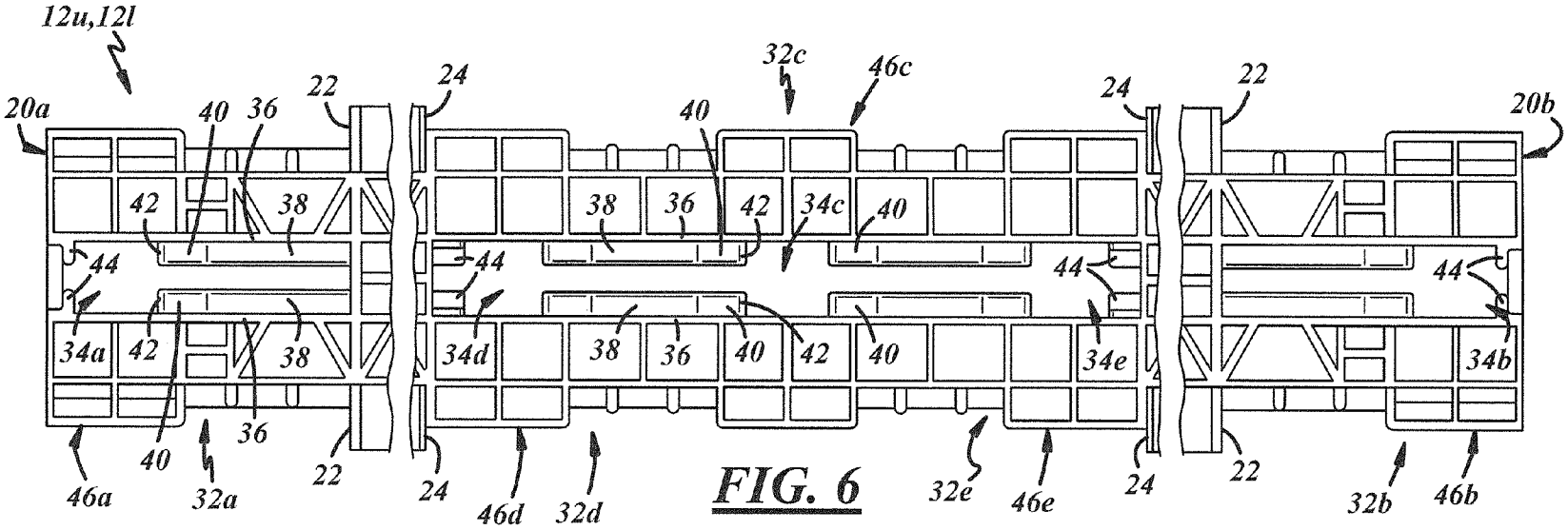
FIG. 6 is a plan view of an exemplary embodiment of an inner surface of a modular board that may be used with the modular pallets of FIGS. 1-5.
Figure 7:
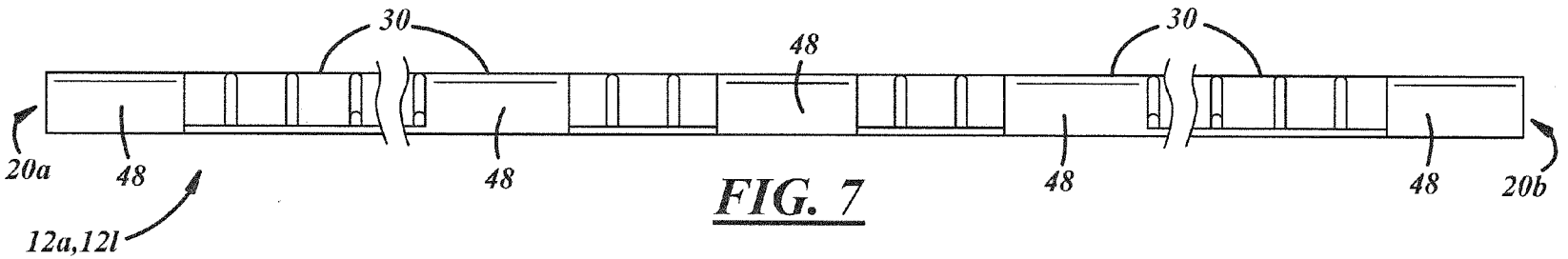
FIG. 7 is a side view of the modular board of FIG. 6.
Figure 8:
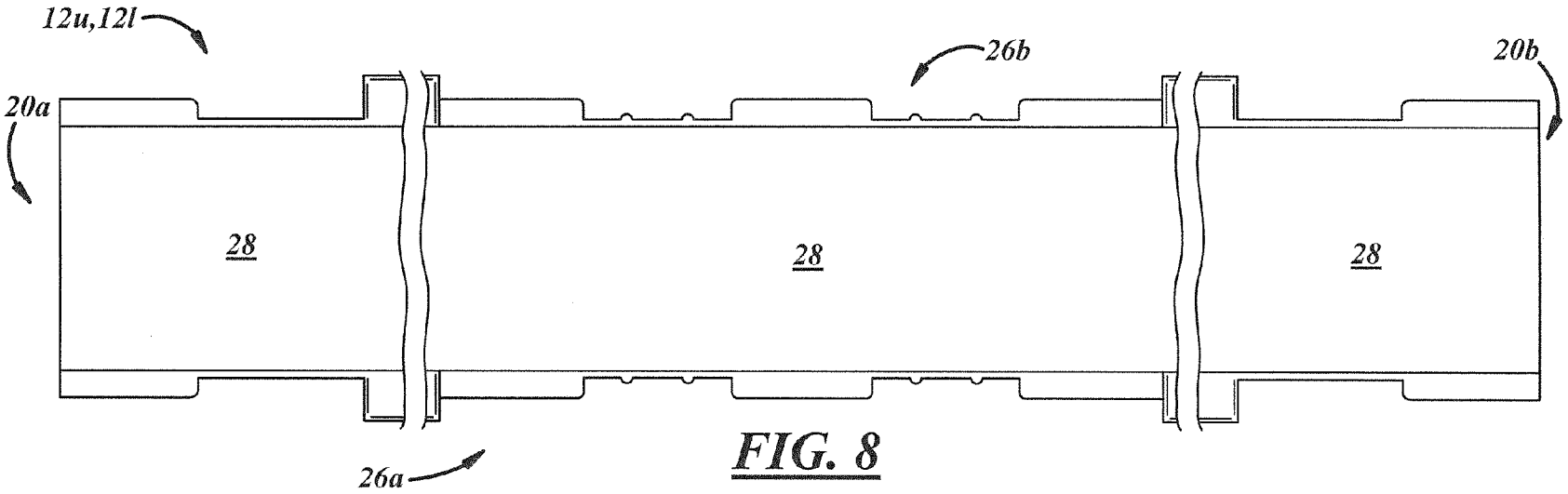
FIG. 8 is a plan view of an exemplary embodiment of an outer side of the modular board of FIG. 6.

Referring now to FIGS. 6 through 8, the boards 12*u*, 12*l* may be identical to one another. The boards 12*u*, 12*l* may include first ends 20*a*, second ends 20*b* oppositely disposed from the first ends 20*a*, the outboard facing shoulders 22, the inboard facing shoulders 24, first edges 26*a*, and second edges 26*b* oppositely disposed from the first edges 26*a* (FIG. 8). The boards 12*u*, 12*l* also may include outer surfaces 28 longitudinally extending between the ends 20*a*, 20*b* and transversely extending between the edges 26*a*, 26*b* (FIG. 8). The boards 12*u*, 12*l* further may include inner surfaces 30 longitudinally extending between the ends 20*a*, 20*b* and transversely extending between edges 26*a*, 26*b* (FIGS. 7-8).

Referring to FIG. 6, the boards 12*u*, 12*l* also include a plurality of mating sections 32, including first and second mating sections 32*a*, 32*b* at the first and second ends 20*a*, 20*b*, a third mating section 32*c* disposed between the first and second mating sections 32*a*, 32*b*, and fourth and fifth spaced apart mating sections 32*d*, 32*e* disposed inboard of the first and second mating sections 32*a*, 32*b* and outboard of the third mating section 32*c*.

The mating sections 32 may include a plurality of locking sockets 34 (34*a*, 34*b*, 34*c*, 34*d*, 34*e*) that are disposed between the inner and outer surfaces 28, 30 and open to the inner surface 30. Each locking socket 34 may include sidewalls 36, at least one rail 38 disposed between the sidewalls and having an inner portion spaced from the inner surface 30, and at least one ramp 40 that may terminate the at least one rail 38. The at least one rail 38 may include a pair of transversely spaced apart rails 38 and the at least one ramp 40 likewise may include a pair of transversely spaced apart ramps 40. Each ramp 40 may have an apex 42 extending in a direction away from the rail 38 and spaced from the inner surface 30 to leave a space therebetween. Each locking socket 34 also may include one or more end walls 44. For the third mating section 34*c*, the end walls may be the opposed ends of the opposing ramps 40. Each ramp 40 may be disposed between the at least one rail and the at least one end wall.

Each board mating section 32*a* through 32*e* also may include a tab section 46*a* through 46*e* corresponding to the locking sockets 34*a* through 34*e*. The tab sections 46*a* through 46*e* may include portions of the first and second edges 26*a*, 26*b* (FIG. 8) that are angled at 48 (FIG. 7) such that the outer surface 28 is narrower than the inner surface 30 at the tab sections. The tab sections may be dove-tail shaped in end view and/or in transverse cross-sectional view therethrough.

Figure 9:
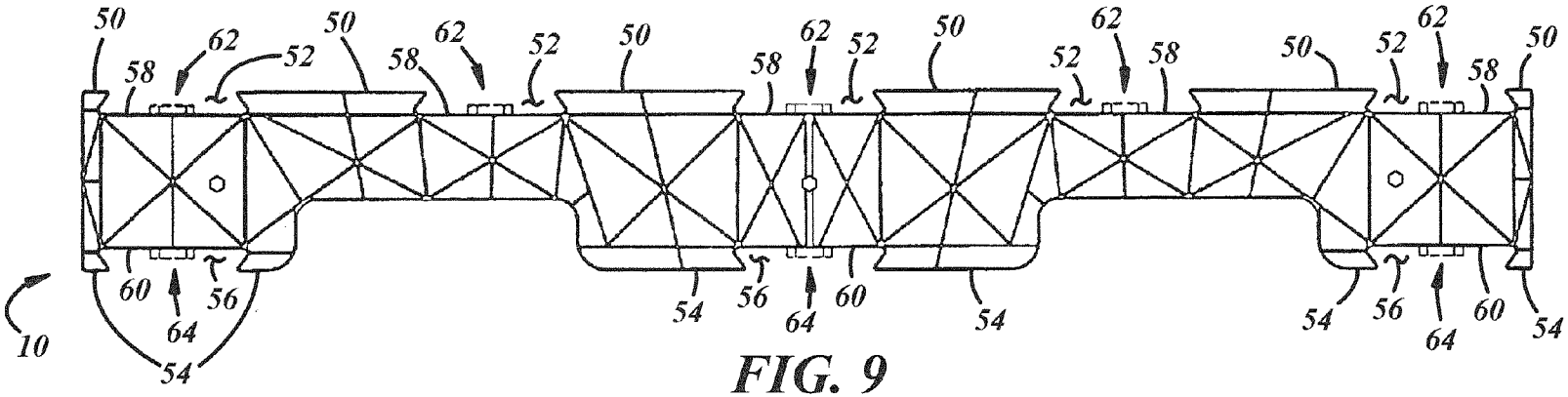
FIG. 9 is a side view of an exemplary embodiment of a modular stringer that may be used with the modular pallets of FIGS. 1-5.

Referring to FIG. 9, the stringers 10 may be identical and each stringer 10 includes a top surface 50 and a plurality of spaced upper grooves 52 formed in the top surface 50 for mating with the tab sections 46 of corresponding ones of the upper boards 12*u*. Each stringer also may include a bottom surface 54 and a plurality of spaced lower grooves 56 formed in the bottom surface 54 for mating with the tab sections 46 of corresponding ones of the lower boards 12*l*. Each groove 52, 56 includes a base 58, 60 and at least one locking projection 62, 64 extending from the base 58, 60 for snap receipt in the corresponding locking socket 34 of the corresponding board 12*u*, 12*l*. The grooves 52, 56 may be dove-tail shaped to correspond to the tab sections 46.

In general, the components of the modular pallet may be manufactured according to techniques known to those skilled in the art, including molding, machining, stamping, and the like. Also, the modular pallet may be assembled according to known techniques. Likewise, any suitable materials can be used in making the components, such as metals, composites, polymeric materials, and/or the like.

As used in the sections above and claims below, the terms "for example," "for instance," and "such as," and the verbs "comprising," "having," "including," and their other verb forms, when used in conjunction with a listing of one or more components or other items, are each to be construed as open-ended, meaning that the listing is not to be considered as excluding other, additional components, elements, or items. Similarly, when introducing elements of the invention or the example embodiments thereof, the articles "a," "an," "the," and "said" are intended to mean that there are one or more of the elements. Moreover, directional words such as front, rear, top, bottom, upper, lower, radial, circumferential, axial, lateral, longitudinal, vertical, horizontal, transverse, and/or the like are employed by way of description and not limitation. Other terms are to be construed using their broadest reasonable meaning unless they are used in a context that requires a different interpretation.

Finally, the foregoing description is not a definition of the invention, but is a description of one or more examples of exemplary embodiments of the invention. The statements contained in the foregoing description relate to the particular examples and are not to be construed as limitations on the scope of the invention as claimed below or on the definition of terminology used in the claims, except where terminology is expressly defined above. And although the present invention has been disclosed using a limited number of examples, many other examples are possible and it is not intended herein to mention all of the possible manifestations of the invention. In fact, other modifications, variations, forms, ramifications, substitutions, and/or equivalents will become apparent to those skilled in the art in view of the foregoing description. The present invention is intended to embrace such forms, ramifications, modifications, variations, substitutions, and/or equivalents as fall within the spirit and broad scope of the following claims. In other words, the present invention encompasses many substitutions or equivalents of limitations recited in the following claims. For example, the materials, sizes, and shapes, described above could be readily modified or substituted with other similar materials, sizes, shapes, and/or the like. Therefore, the invention is not limited to the particular examples of exemplary embodiments disclosed herein, but instead is defined solely by the claims below.

The invention claimed is:

1. A modular pallet, comprising:

at least four spaced stringers each including a plurality of spaced upper grooves formed in a top surface and a plurality of spaced lower grooves formed in a bottom surface, and each including at least one locking projection extending from a groove base of each of the upper and lower grooves;

a plurality of elongated upper boards each including a first upper board mating section approximate a first end, a second upper board mating section approximate a second end, and a middle pair of upper board mating sections between the first and second upper board mating sections, wherein at least a portion of the upper boards adjacent the first, middle pair, and second upper board mating sections are shaped to be received by the upper grooves in the stringers and interlocked at the first, middle pair, and second upper board mating sections to different ones of the stringers by movement of at least one of the stringer member or the upper board with respect to each other, wherein the upper board mating sections include at least one upper locking socket for receiving the corresponding at least one locking projection of the stringers; and a plurality of elongated lower boards including a first lower board mating section approximate a first end, a second lower board mating section approximate a second end, and a middle pair of lower board mating sections between the first and second lower board mating sections, wherein at least a portion of lower boards adjacent the first, middle pair, and second lower board mating sections of the lower boards are shaped to be received by the lower grooves in the stringers and interlocked at the first, middle pair, and second lower board mating sections to different ones of the stringers by movement of at least one of the stringer member or the lower board with respect to each other, and wherein the direction of the movement is transverse with respect to the stringers, wherein the lower board mating sections include at least one lower locking socket for receiving the corresponding at least one locking projection of the stringers, wherein the stringers include an outboard pair of spaced apart stringers and an inboard pair of spaced apart stringers disposed between the outboard pair of spaced apart stringers, and wherein the boards have inboard facing shoulders adjacent to corresponding mating sections spaced from the ends of the boards, wherein the inboard pair of spaced apart stringers abuts the inboard facing shoulders.

2. The pallet of claim 1, wherein the upper and lower boards are interchangeable, and wherein the upper and lower grooves are substantially identical.

3. The pallet of claim 1, wherein the stringers include a plurality of bracing ribs formed at an angle with respect to an upper flange and a lower flange.

4. The pallet of claim 3, wherein the plurality of bracing ribs are formed on opposite sides of a center web that extends between the upper and lower flanges and runs along a center of the stringers.

5. The pallet claim 1, wherein each of the stringers includes at least two spaced channels opening to the bottom surface and shaped to receive a lifting member of a lifting device.

6. The pallet of claim 1, wherein the upper and lower grooves are narrower at a groove opening than at a groove base.

7. The pallet of claim 1, wherein the at least one locking projection includes two parallel locking ribs.

8. The pallet of claim 1, wherein each of the upper boards include a plurality of intersecting support ribs with a skin formed on one side of the support ribs and acting as a top surface of the upper board.

9. The pallet of claim 1, wherein each of the lower boards include a plurality of intersecting support ribs with a skin formed on one side of the support ribs and acting as a bottom surface of the lower board.

10. The pallet of claim 1, wherein the upper and lower boards and the stringers are made of at least one of polyethylene or polypropylene.

11. A modular pallet, comprising:

at least four spaced stringers each including a plurality of spaced upper grooves formed in a top surface and a plurality of spaced lower grooves formed in a bottom surface, and each including at least one locking projection extending from a groove base of each of the upper and lower grooves;

a plurality of elongated upper boards each including a first upper board mating section approximate a first end, a second upper board mating section approximate a second end, and a middle pair of upper board mating sections between the first and second upper board mating sections, wherein at least a portion of the upper boards adjacent the first, middle pair, and second upper board mating sections are shaped to be received by the upper grooves in the stringers and interlocked at the first, middle pair, and second upper board mating sections to different ones of the stringers by movement of at least one of the stringer member or the upper board with respect to each other, wherein the upper board mating sections include at least one upper locking socket for receiving the corresponding at least one locking projection of the stringers; and a plurality of elongated lower boards including a first lower board mating section approximate a first end, a second lower board mating section approximate a second end, and a middle pair of lower board mating sections between the first and second lower board mating sections, wherein at least a portion of lower boards adjacent the first, middle pair, and second lower board mating sections of the lower boards are shaped to be received by the lower grooves in the stringers and interlocked at the first, middle pair, and second lower board mating sections to different ones of the stringers by movement of at least one of the stringer member or the lower board with respect to each other, and wherein the direction of the movement is transverse with respect to the stringers, wherein the lower board mating sections include at least one lower locking socket for receiving the corresponding at least one locking projection of the stringers, wherein the stringers include a first outboard pair of spaced apart stringers and an inboard pair of spaced apart stringers disposed between the first outboard pair of spaced apart stringers, and wherein the stringers also include a second outboard pair of spaced apart stringers disposed between the first outboard pair of spaced apart stringers and disposed outboard of the inboard pair of spaced apart stringers, and wherein the first and second outboard pairs of spaced apart stringers are in adjacent contact, and wherein the boards have outboard facing shoulders adjacent to corresponding mating sections spaced from the ends of the boards, wherein the second outboard pair of spaced apart stringers is trapped between the outboard facing shoulders and the first outboard pair of spaced apart stringers.

12. The pallet of claim 1, wherein the stringers also include a second outboard pair of spaced apart stringers disposed between the outboard pair of spaced apart stringers and disposed outboard of the inboard pair of spaced apart stringers and wherein the outboard pairs of spaced apart stringers are in adjacent contact.

13. The pallet of claim 12, wherein the outboard pairs of spaced apart stringers are coupled together.

14. The pallet of claim 13, wherein the outboard pairs of spaced apart stringers are coupled together by screws.

15. The pallet of claim 13, wherein the outboard pairs of spaced apart stringers are coupled together by clips.

16. The pallet of claim 12 wherein the boards are fastened to the second outboard pair of spaced apart stringers.

17. The pallet of claim 12 wherein the boards have outboard facing shoulders spaced from the ends of the boards, wherein the second outboard pair of spaced apart stringers is trapped between the outboard facing shoulders and the first outboard pair of spaced apart stringers.

18. A board for a modular pallet, comprising:

a first end;

a second end oppositely disposed from the first end;

a first edge;

a second edge oppositely disposed from the first edge;

an outer surface longitudinally extending between the ends and transversely extending between the edges;

an inner surface longitudinally extending between the ends and transversely extending between edges;

a plurality of mating sections, including first and second mating sections at the first and second ends, and fourth and fifth spaced apart mating sections disposed inboard of the first and second mating sections, and a third mating section between the fourth and fifth spaced apart mating sections wherein the fourth and fifth spaced apart mating sections include tab sections including angled portions along the edges; and inboard facing shoulders spaced from the ends of the boards and adjacent to and not spaced apart from the tab sections.

19. The board of claim 18, wherein the tab sections are dove-tail shaped.

20. A modular pallet comprising:

a plurality of the board of claim 18; and a first pair of stringers including first and second stringers disposed at the first and second ends of the boards; and a second pair of stringers including third and fourth stringers spaced apart from one another disposed between the first pair of stringers.

21. The modular pallet of claim 20 further comprising a third pair of stringers including fifth and sixth stringers disposed between the first pair of stringers and in adjacent contact therewith.

22. The modular pallet of claim 21 further comprising a seventh stringer disposed between the second pair of stringers and spaced apart therefrom.

23. The modular pallet of claim 21, wherein the boards have outboard facing shoulders spaced from the ends of the boards, and wherein the third pair of stringers are trapped between the outboard facing shoulders and the first pair of stringers.

24. The modular pallet of claim 21, wherein each board mating section includes:

a locking socket disposed between the inner and outer surfaces and open to the inner surface, and including:

sidewalls, at least one end wall, at least one rail disposed between the sidewalls and having an inner portion spaced from the inner surface, and at least one ramp disposed between the at least one rail and the at least one end wall and having an apex spaced from the inner surface; and one of the tab sections corresponding to the locking socket, and including portions of the first and second edges that are angled such that the outer surface is narrower than the inner surface at the tab sections.

25. The modular pallet of claim 24 wherein each stringer includes a plurality of spaced upper grooves formed in a top surface for mating with the tab section of a corresponding one of the boards, and a plurality of spaced lower grooves formed in a bottom surface for mating with the tab section of another corresponding one of the boards, and each groove including a base and at least one locking projection extending from the base for snap receipt in the corresponding locking socket of the corresponding board.

26. The modular pallet of claim 25 wherein the grooves and tab sections are dove-tail shaped.

27. The board of claim 18, further comprising outboard facing shoulders spaced from the ends.

* * * * *